US006366263B1

(12) United States Patent
Takasu et al.

(10) Patent No.: US 6,366,263 B1
(45) Date of Patent: Apr. 2, 2002

(54) IMAGE-SIZE VARYING APPARATUS, IMAGE-SIZE VARYING METHOD, AND MONITOR APPARATUS

(75) Inventors: Shigeru Takasu, Tokyo; Toshinori Hamada, Kanagawa; Motosuke Irie, Chiba; Satoru Suzuki, Tokyo, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/034,938

(22) Filed: Mar. 4, 1998

(30) Foreign Application Priority Data

Mar. 7, 1997 (JP) ..... 9-053036

(51) Int. Cl.[7] ..... G09G 3/00
(52) U.S. Cl. ..... 345/13
(58) Field of Search ..... 345/127, 128, 345/129, 130, 13, 14, 660

(56) References Cited

U.S. PATENT DOCUMENTS 5,453,846 A * 9/1995 Tsao et al. ..... 358/448
5,537,149 A * 7/1996 Teraoka et al. ..... 348/556
5,686,969 A * 11/1997 Baik ..... 348/556
5,719,594 A * 2/1998 Potu ..... 345/130
5,786,802 A * 7/1998 Park ..... 345/127
5,793,350 A * 8/1998 Chandavarkar et al. ..... 345/127
5,874,937 A * 2/1999 Kesatoshi ..... 345/127
5,969,706 A * 10/1999 Tanimoto et al. ..... 345/130

* cited by examiner

*Primary Examiner*—Almis R. Jankus
(74) *Attorney, Agent, or Firm*—Frommer Lawrence & Haug LLP; William S. Frommer; Darren M. Simon

(57) ABSTRACT

The size of an image displayed on a tube surface is varied while maintaining the aspect ratio thereof at a constant. First, if there is information of an arbitrary horizontal-size variable parameter and a vertical-size variable parameter because of parameters supplied previously by adjustments, the horizontal/vertical size of a raster formed at that time can be obtained, and the aspect ratio thereof can be obtained on the basis of the horizontal/vertical size of the raster. Then, during a zoom mode, the vertical-size variable parameter corresponding to the updated horizontal-size variable parameter is computed so that the detected aspect ratio becomes constant, and the raster size is changed in accordance with these values.

16 Claims, 8 Drawing Sheets

IMAGE-SIZE VARYING APPARATUS, IMAGE-SIZE VARYING METHOD, AND MONITOR APPARATUS

BACKGROUND OF THE INVENTION

1. Field of the Invention

The present invention relates to an image-size varying apparatus which varies, for example, the size of a display image in the horizontal/vertical direction, an image-size varying method, and a monitor apparatus comprising such an image-size varying apparatus.

2. Description of the Related Art

In recent years, as display apparatuses for displaying and outputting an image for a computer apparatus, the use of display apparatuses with a CRT (Cathode-Ray Tube) as a display device have become widespread. Generally, such a display apparatus has the function such that the size (image size) of a display image can be varied by a user as desired by varying the length (horizontal size) of an image displayed on a tube surface along the horizontal direction thereof and the length (vertical size) thereof along the vertical direction. When the display image is associated with a computer apparatus, the display image referred to herein refers to a desktop screen and a window screen displayed on the tube surface.

Such a function for varying the image size is known in which the horizontal size and the vertical size of an actual display image are varied by varying a parameter for controlling the variation of the horizontal size and a parameter for controlling the variation of the vertical size independently of each other for each step in such a manner as to correspond to the operation by the user. Or, a function for varying the image display area is known in which the image size is varied by simultaneously varying the horizontal size and the vertical size of the display image on the basis of a preset fixed ratio.

Meanwhile, depending upon the way in which a user will use it, a situation may naturally occur where there is a need to change the image size while, for example, the balance of the aspect ratio of figures, characters, and the like, drawn on the display screen is not distorted, that is, the original aspect ratio of the display image is maintained. However, in the above-described image-size varying method, it is difficult to vary as desired the image size while maintaining the aspect ratio of the display image, because of the factors described below.

One of the factors is an influence from hardware. For example, the amount of variation of each of the horizontal and vertical sizes of the actual image, corresponding to one step of the parameter control value for varying the image size, is determined by the configuration of the internal deflection circuit and the like, and differs, for example, from model to model. For this reason, even if, for example, the parameter control value is varied so as to simply enlarge or reduce by one step in each of the horizontal and vertical directions, the aspect ratio (the ratio of the horizontal size to the vertical size) of the display image after the size has been changed differs from the aspect ratio of the original display image.

Also, there is an influence from the difference in the active ratio of the display image with respect to the raster formed on the tube surface.

Here, the raster in this specification refers to an area formed on the tube surface as a result of deflecting an electron beam by a deflection yoke. The size (raster size) is the size of an interval corresponding to the interval such that the retrace interval is removed from the deflection cycle. Hereinafter, the size of the raster in the horizontal direction will be referred to as a horizontal raster size, and the size of the raster in the vertical direction as a vertical raster size.

Also, the active ratio refers to the occupied ratio (horizontal active ratio) of the display image in the horizontal direction with respect to the horizontal raster size, and the occupied ratio (vertical active ratio) of the display image in the vertical direction with respect to the vertical raster size.

For example, FIG. 8A shows a state in which a display image G having an active ratio (horizontal active ratio) of 50% in the horizontal direction with respect to a raster RS is displayed.

Assuming that, for example, the control value is updated so that the horizontal size of the display is enlarged by one step from the display state shown in FIG. 8A, since the monitor apparatus operates so as to enlarge the deflection width in the horizontal direction, on the basis of the control value, in a manner corresponding to one step, the horizontal raster size of the raster RS is enlarged by an amount of variation corresponding to one step.

As the horizontal raster size of the raster RS is enlarged in the manner described above, the horizontal size of the display image G formed within the raster RS is also enlarged. Since the horizontal active ratio of the display image G in this case is 50%, the horizontal size of the display image G is enlarged by an amount of variation corresponding to 0.5 step with respect to the raster RS.

FIG. 8B shows a state in which is formed a raster RS having a raster size and an aspect ratio that are different from those of FIG. 8A, and displayed is a display image G having the same size as that in FIG. 8A with respect to this raster RS. The active ratio of the display image G with respect to the raster RS in this case is assumed to be 90%.

In this case, it is assumed that the control value is updated so that the size is enlarged by one step in the horizontal direction in the same way as in FIG. 8A from the state shown in FIG. 8B. As a result, the horizontal raster size of the raster RS is enlarged by an amount of variation corresponding to one step. Since the horizontal active ratio of the display image G is 90% in this case, the horizontal size of the display image G is enlarged by an amount of variation corresponding to 0.9 step with respect to the raster RS.

As described above, since the active ratio of the display image G with respect to the raster RS differs, even if the number of steps by which the control value is varied is the same, the amount of variation of the size of the display image with respect to this number of steps differs according to the active ratio of the display image G with respect to the raster RS. Although in FIGS. 8A and 8B, a comparison is made in the same horizontal direction, a phenomenon similar to the above occurs also when the size is changed in units of one step in both the horizontal and vertical direction in the case where the active ratio of one display image with respect to a specific raster size is different between the horizontal direction and the vertical direction.

For this reason, in the case where, for example, the horizontal active ratio of the display image with respect to a raster size differs from the vertical active ratio thereof, even if, for example, enlargement/reduction is performed according to an amount of variation with the same number of steps in the horizontal and vertical directions, the result is that the amount of variation of the horizontal size of the display image differs from the amount of variation of the vertical size thereof. Therefore, the aspect ratio of the display image whose size has been changed differs from the aspect ratio of the original display image.

Further, as a factor which makes it difficult to vary the image size while maintaining the aspect ratio of the display image, in the current situation, there is a case in which an adjustment of the image size by the user exerts an influence.

For example, in such a case, in the monitor apparatus, it is assumed that the construction is formed such that the size of the image is varied according to a predetermined fixed ratio as the amount of variation in both the horizontal and vertical direction.

FIG. 9A shows a case in which the horizontal size and the vertical size of the raster are varied simultaneously based on a fixed ratio of 4:3 as an example of an amount of variation in the horizontal and vertical direction. That is, the number of steps of the control value required to vary the vertical size so that the amount of variation of the vertical raster size is three times as great, which will correspond to a number of steps of the control value required to vary the horizontal size so that the amount of variation of the horizontal raster size is four times as great, is determined in advance, and the horizontal and vertical raster sizes are varied simultaneously in accordance with these two numbers of steps.

In FIG. 9A, the raster RS is also assumed to have an aspect ratio of 4:3. It is assumed from this state that the raster RS is enlarged on the basis of a fixed ratio of 4:3 as an amount of variation of the horizontal/vertical raster size, as indicated by the broken line in FIG. 9A.

In this case, since the aspect ratio of the raster RS and the ratio of the size-varying amount in the horizontal/vertical direction are the same at 4:3, the aspect ratio of the display image G is maintained at a constant because the display image G formed on the raster RS is also enlarged at a ratio of 4:3 as the amount of variation of the horizontal size and the vertical size.

Further, in the monitor apparatus for a computer apparatus, a monitor apparatus capable of selecting a plurality of types of resolutions, commonly called a multi-scanning type, is in common use. However, there are cases in which the size of a raster and the aspect ratio of a raster, formed on the tube surface, are different depending upon the set resolution.

Further, in the case where the image size is varied in the conventional monitor apparatus, a method is widely used in which the image size is changed by varying the raster size in both the horizontal direction and the vertical direction independently of each other according to an operation by the user.

Accordingly, the user changes and sets the resolution, or performs an operation on the horizontal direction and the vertical direction independently, from the state shown in FIG. 9A, causing an aspect ratio different from the aspect ratio of 4:3 shown in FIG. 9A to be set as the aspect ratio of the raster. This state is shown in FIG. 9B.

FIG. 9B shows a case in which the aspect ratio of the raster RS is 1:1, as an example. Then, from this state, the image is enlarged as indicated by the broken line in the figure.

In this case, as described above, assuming that it is set that the horizontal size and the vertical size of the raster are simultaneously varied according to a fixed ratio of 4:3 as the amount of variation in the horizontal/vertical direction, if the image is enlarged at this fixed ratio, as shown by the frame of the broken line of the figure, the raster RS whose size has been varied becomes different from the aspect ratio which should be originally 1:1. Further, as a consequence to this, the display image G whose size has been varied is also displayed at an aspect ratio different from the original aspect ratio.

That is, even if a method for varying the image size at a fixed ratio is used, in the current situation, the above-described change of resolution and the independent adjustments of the horizontal/vertical size with respect to the image are performed by the user, and when the raster RS does not match the above-described fixed ratio, an inconvenience of the aspect ratio of the image becoming different occurs.

For example, regarding the resolution, the following is considered that the fixed ratio when the image size is varied is set and changed in such a manner as to correspond to each resolution prepared beforehand. Since some computer apparatuses have many types of resolution, however, it is not efficient to set a fixed ratio corresponding to all of these resolutions.

SUMMARY OF THE INVENTION

Accordingly, it is an object of the present invention, the achievement of which will solve the above-described problems, to make it possible to vary an image size while the aspect ratio of a display image is always maintained at a constant by absorbing the condition for the difference in the amount of variation in the horizontal/vertical size of the raster by hardware, the condition for the active ratio of the display image with respect to the raster size, the condition for the aspect ratio which is varied by the adjustment of the image size by an operation by the user, and other conditions.

To achieve the above-described object, according to one aspect of the present invention, there is provided a raster scan display apparatus for displaying an input video signal, the raster scan display apparatus comprising: first changing means for changing one length of an image display area along the horizontal or vertical direction thereof; computation means for computing the other length of the image display area along the horizontal or vertical direction after the size is changed by using the one changed length and the aspect ratio of the image display area before the size is changed; and second changing means for changing the other length of the image display area along the horizontal or vertical direction on the basis of the other length determined by the computation means.

According to another aspect of the present invention, there is provided a size changing method of changing the size of an image display area of a raster scan display apparatus for displaying an input video signal, the method comprising: a first step for changing one length of an image display area along the horizontal or vertical direction thereof; a second step for computing the other length of the image display area along the horizontal or vertical direction after the size is changed by using the one detected length and the aspect ratio of the image display area before the size is changed; and a third step for changing the other length of the image display area along the horizontal or vertical direction on the basis of the other computed length.

With the above-described construction, if, for example, only the information of a horizontal raster-size variable control value and the information of a vertical raster-size variable control value are given, the information of the aspect ratio of the actually displayed raster is obtained. Then, if the horizontal raster-size variable control value and the vertical raster-size variable control value are varied simultaneously so that this aspect ratio becomes constant, it becomes possible to perform the enlargement/reduction of the raster size while maintaining the aspect ratio at a constant.

The above and further objects, aspects and novel features of the invention will become more apparent from the following detailed description when read in connection with the accompanying drawings.

DESCRIPTION OF THE PREFERRED EMBODIMENT

The preferred embodiment of the present invention will be described below. The description will be given in the following sequence.

<1. The construction of a monitor apparatus>

<2. The operation during zoom mode>

<3. The construction for realizing the zoom function in this embodiment>

(3-a. The principle for realizing the zoom function in this embodiment)

(3-b. The adjustment method)

(3-c. The processing operation during zoom mode)

<1. The Construction of a Monitor Apparatus>

Figure 1:
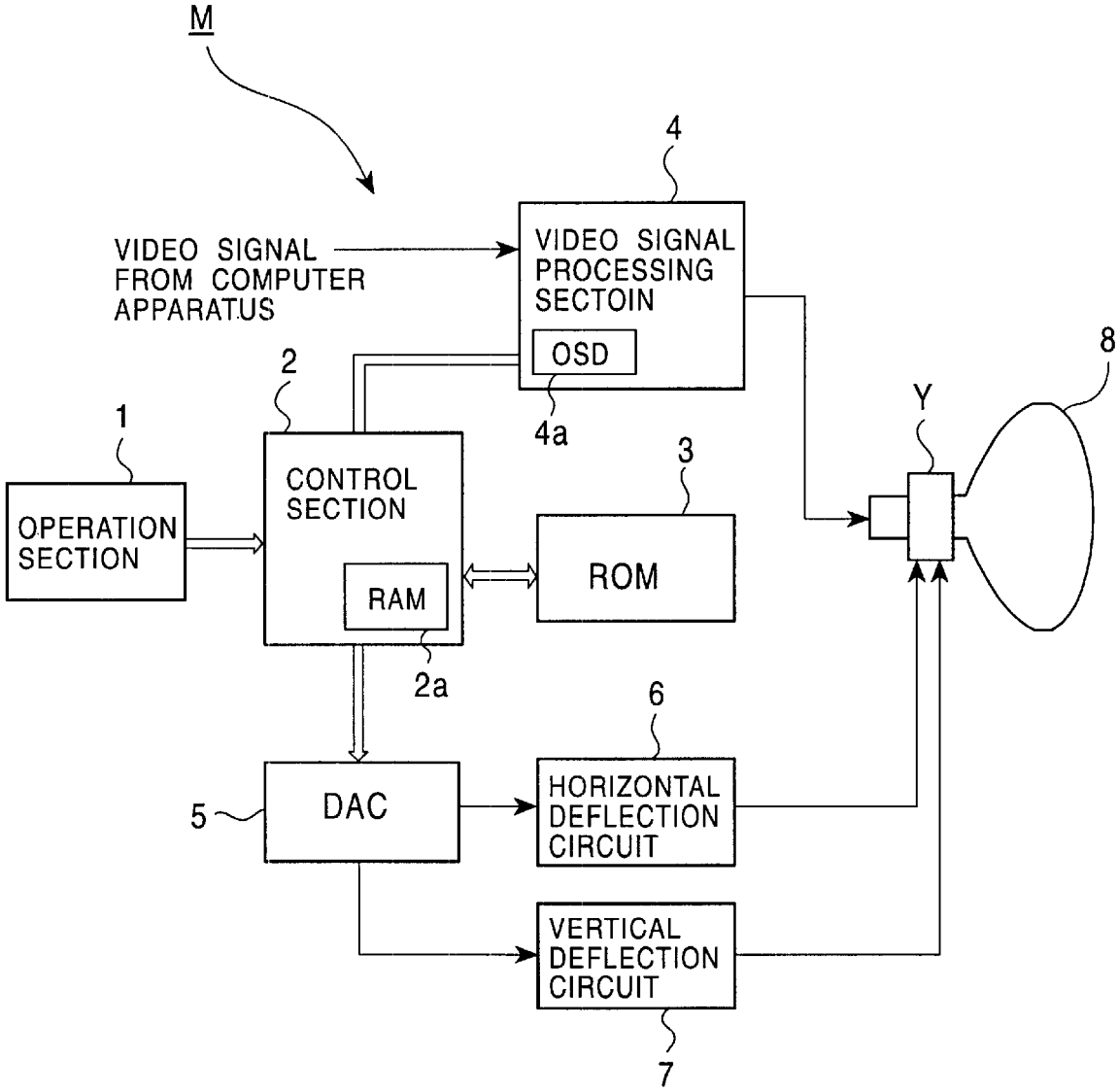
FIG. 1 is a block diagram showing an example of the construction of a monitor apparatus according to an embodiment of the present invention.

FIG. 1 is a block diagram illustrating the internal construction of a monitor apparatus according to an embodiment of the present invention. The monitor apparatus of this embodiment is constructed as a computer-apparatus-compatible display apparatus capable of displaying a video image output from a computer apparatus.

In the monitor apparatus shown in FIG. 1, a video signal (for example, an RGB signal) provided from the computer apparatus (not shown) is provided to a video-signal processing circuit 4. The video-signal processing circuit 4 performs a predetermined video-signal processing, an amplifying processing, and the like on the input video signal and outputs it to a CRT (Cathode-Ray Tube) 8.

Further, the video-signal processing circuit 4 in this embodiment comprises an on-screen display (OSD) circuit 4*a*. This on-screen display circuit 4*a* generates predetermined image information under the control of a control section 2 and performs a process for synthesizing the video signal of this image information into a video signal provided from the computer apparatus. In this embodiment, generation of image information for an adjustment window is made possible by the operation of the OSD circuit 4*a,* and a display can be produced by superimposing the adjustment window onto the display screen, as will be described later.

An operation section 1 is provided with a group of keys required for performing various operations and adjustments for the monitor apparatus. The operation information for the operation section 1 is transmitted to the control section 2, and the control section 2 performs a predetermined control operation as required in response to this operation information. In this embodiment, as described later, a "zoom mode" for performing a zoom function of performing enlargement/reduction while maintaining the aspect ratio of the display image at a constant is provided so that a predetermined operation for the zoom mode can be performed by the operation section 1.

Further, this monitor apparatus M is constructed in such a way that a resolution switching request can be made, and the horizontal and vertical sizes of the image (raster) can be varied independently of each other, and such operations can be performed by the operation section 1.

The control section 2, formed of, for example, a microcomputer, performs a required control operation for the operation of the monitor apparatus in accordance with, for example, the operation information transmitted from the operation section 1, the operating state of the monitor apparatus, and the like. In this embodiment, when a required operation in the zoom mode is performed on the operation section 1, the control section 2 performs control for enlarging/reducing the display image while maintaining the aspect ratio of the display image at a constant in accordance with the processing operation to be described later.

This control section 2 is constructed so as to perform control for the horizontal/vertical deflection circuit system in order to change, for example, the resolution, the vertical/horizontal sizes of the image (including the zoom mode), and others.

In this case, the control section 2 outputs horizontal/vertical deflection control data corresponding to, for example, a set resolution, image size, and the like to a D/A converter 5. The D/A converter 5 converts the provided horizontal/vertical deflection control data into analog signals and generates a horizontal deflection control signal and a vertical deflection control signal, and outputs the horizontal deflection control signal to a horizontal deflection circuit 6 and the vertical deflection control signal to a vertical deflection circuit 7.

The horizontal deflection circuit 6 generates a horizontal drive signal in accordance with the input horizontal deflection control signal and supplies it to a deflection yoke Y, and the vertical deflection circuit 7 generates a vertical drive signal in accordance with the input vertical deflection control signal and supplies it to the deflection yoke Y. As a result, a display is made in such a way that a raster of a size corresponding to the set horizontal/vertical sizes is displayed on the tube surface of the monitor apparatus.

Further, the control section 2 comprises a RAM 2*a* where the results of computations performed by the control section 2 and the like are held.

A ROM 3 has stored therein programs for control required for the operation of the monitor apparatus, and the like; for example, an EEPROM (Electrically Erasable and Programmable ROM) can be used. In particular, in this embodiment, as a parameter used when the zoom mode for performing enlargement/reduction while maintaining the aspect ratio of the display image at a constant, a necessary parameter value has been stored in the ROM 3, which parameter value is determined, for example, by adjustments before shipment from the factory. This will be described later.

<2. The Operation During Zoom Mode>

In this embodiment, a zoom mode capable of performing enlargement/reduction while maintaining the aspect ratio of the display image at a constant is provided as described above. The steps of the operation during the zoom mode, in which this zoom function is performed, will be described with reference to FIGS. 2A, 2B and 2C.

Figure 2A:
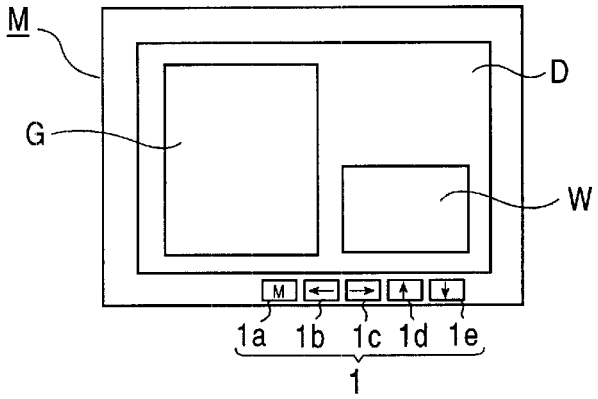
FIGS. 2A, 2B and 2C are views illustrating the operation steps during the zoom mode in this embodiment.

FIG. 2A is a view when the monitor apparatus M is viewed from front. When, for example, the user wants to enlarge or reduce the display image G displayed currently on the display screen D by the zoom mode, the user first operates a menu key 1*a* from among a group of keys provided in the monitor apparatus M. Thereupon, an adjustment window W is displayed on the display screen D in such a manner as to be superimposed. The display of this adjustment window W is realized by synthesizing the image information of the adjustment window W generated by the OSD circuit 4*a* within the video-signal processing circuit 4 into the video signal from the computer apparatus under the control of the control section 2.

Figure 2B:
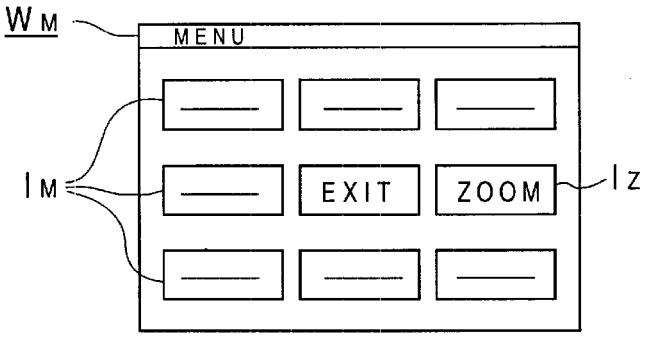

Here, as the adjustment window W displayed when the menu key 1*a* is operated first, for example, a menu window $W_M$ shown in FIG. 2B is displayed.

Within this menu window $W_M$, adjustment items for performing various adjustments for the monitor apparatus are displayed as a menu item icon $I_M$ for each of the items. Although not shown in the figures here, in practice, a character, symbol, or the like which indicates what kind of the adjustment item it is, is displayed for each menu item icon $I_M$. The selection of these menu item icons $I_M$ can be made as desired by moving them in the up-and-down, and right-to-left directions by the right and left keys 1*b* and 1*c* and the up and down keys 1*d* and 1*e* in the operation section 1.

In this case, in the menu item icons $I_M$, as shown in FIG. 2B, a zoom-item icon $I_Z$ for moving to the zoom mode is present. When this zoom-item icon $I_Z$ is selected and the menu key 1*a* is operated again, the mode moves to the zoom mode, and regarding the adjustment window W, the display is switched from the menu window $W_M$ to the zoom adjustment window $W_Z$ shown in FIG. 2C.

Figure 2C:
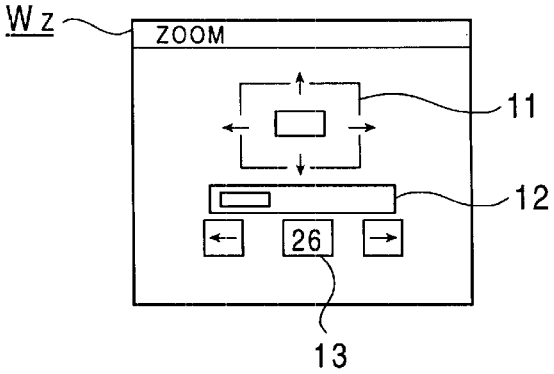

In the zoom adjustment window $W_Z$ shown in FIG. 2C, for example, shown are a zoom icon I1 which symbolically indicates the direction in which the image is enlarged/reduced and the size thereof, an icon I2 which graphically indicates the above, and a parameter value icon I3 which indicates an enlargement/reduction parameter by a numerical value.

In this case, in a state in which the zoom adjustment window $W_Z$ is displayed, the right and left keys 1*b* and 1*c* are operated while confirming the icons I1, I2, and I3 displayed within the zoom adjustment window $W_Z$. In this embodiment, enlargement or reduction is performed in response to this key operation while maintaining the aspect ratio of the display image at a constant.

When it is desired to erase the menu window $W_M$ shown in FIG. 2B, for example, the menu item icon M displayed as "EXIT" within the menu window $W_M$ may be selected and the menu key may be operated. Further, if the menu key is operated in a state in which the zoom adjustment window $W_Z$ shown in FIG. 2C is displayed, it is possible to return to the menu window $W_M$ shown in FIG. 2B.

Also, the above-described switching and setting of the resolution, and the independent adjustment of the horizontal/vertical sizes of the image size can be performed by the user by performing, for example, the steps of the operation on the menu window $W_M$ shown in FIG. 2B.

<3. The Construction for Realizing the Zoom Function in this Embodiment>

(3-a. The principle for realizing the zoom function in this embodiment)

Here, the principle for realizing the zoom function in this embodiment will be described with reference to FIGS. 3A and 3B.

Figure 3A:
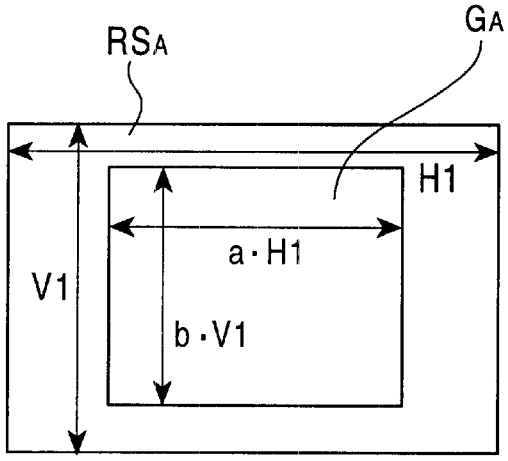
FIGS. 3A and 3B are views illustrating the principle for realizing a zoom function in this embodiment.

FIG. 3A shows a state in which a display image $G_A$ is displayed having a horizontal size=a·H1 (a is a constant corresponding to the horizontal active ratio) and a vertical size=b·V1 (b is a constant corresponding to the vertical active ratio) with respect to a raster $RS_A$ having a horizontal raster size=H1 and a vertical raster size=V1.

Figure 3B:
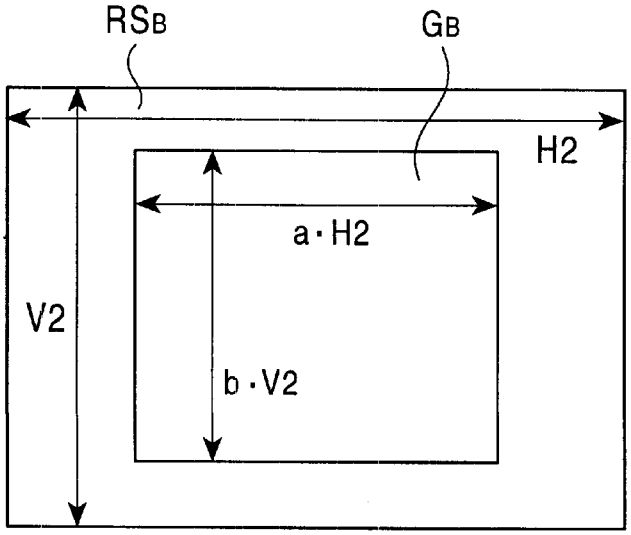

FIG. 3B shows a state in which displayed are a raster $RS_B$ having a horizontal raster size=H2 and a vertical raster size=V2, different from the sizes of the raster $RS_A$ of FIG. 3A, and a display image $G_B$ having a horizontal size=a·H2 and a vertical size=b·V2 with respect to this raster RS.

Here, a case is considered in which in varying the image size so as to change from the state of the display image $G_A$ shown in FIG. 3A to the state of the display image $G_B$ shown in FIG. 3B, the aspect ratio of the display image $G_B$ after the size has been varied becomes the same as the aspect ratio of the display image $G_A$ before the size has been varied.

As described above, in the monitor apparatus M of this embodiment, the image size is varied by controlling the deflection circuit system (the horizontal deflection circuit 6 and the vertical deflection circuit 7) so as to vary the deflection width by the electron beam. Therefore, in practice, the horizontal size and the vertical size of the raster are varied, with the result that the horizontal/vertical size of the display image formed on the raster is varied.

Assuming the above-described conditions, in order that the aspect ratio of the display image $G_B$ becomes the same as that of the display image $G_A$, the following relation may be satisfied among the horizontal size a·H1 and the vertical size b·V1 of the display image $G_A$, and the horizontal size a·H2 and the ver tical size b·V2 of the display image $G_B$:

$$\frac{b \cdot V1}{a \cdot H1} = \frac{b \cdot V2}{a \cdot H2} \tag{1}$$

For this purpose, the horizontal size and the vertical size of the raster may be varied simultaneously so that the following may be satisfied as the relation among the horizontal raster size H1 and the vertical raster size V1 of the raster $RS_A$, and the horizontal raster size H2 and the vertical raster size V2 of the raster $RS_B$:

$$\frac{V1}{H1} = \frac{V2}{H2} \tag{2}$$

That is, if the aspect ratio of the raster is constant when the image size is varied, in association with this, the aspect ratio of the display image formed on the raster is also maintained so as to be constant.

(3-b. The adjustment method)

Accordingly, in the monitor apparatus of this embodiment, in order to realize a zoom function which maintains the aspect ratio of the display image at a constant, adjustments are made as described below in the manufacturing stage, such as before shipment from the factory, on the basis of the above-described principle, and various parameter values prepared for use for the adjustments at this time and predetermined parameter values obtained by these adjustments are stored in the ROM 3. These parameter values are used when the aspect ratio of the raster is changed as will be described later, and for the computation process during the zoom mode.

In this case, to realize the zoom function in this embodiment, for the monitor apparatus M shown in FIG. 1, the conditions described in (1) to (3) below are set.

(1) The variable control of the horizontal/vertical size for the raster displayed on the tube surface of the CRT is made possible by digital control by a microcomputer or the like.

(2) In a multiscanning-compatible type (multiple-signal-receiving type), if the variable parameter of the horizontal raster size and the variable parameter of the vertical raster size are the same among the respective resolutions, the size of the formed raster is the same irrespective of the deflection frequency. If this condition was not satisfied from the viewpoint of circuit configuration, a frequency characteristic adjustment function by, for example, software processing is added.

(3) The horizontal linearity and the vertical linearity of the CRT are maintained satisfactorily.

The variables and constants used in the description that follows are defined as described below:

Hsize1: the horizontal size of an adjustment image G1 (image size 1)

Vsize1: the vertical size of the adjustment image G1 (image size 1)

Hsize2: the horizontal size of an adjustment image G2 (image size 2)

Vsize2: the vertical size of the adjustment image G2 (image size 2)

H_SIZE: horizontal-size variable parameter [data]

V_SIZE: vertical-size variable parameter [data]

H_SIZE_1: H_SIZE during adjustment of Hsize1 [data]

V_SIZE_1: V_SIZE during adjustment of Vsize1 [data]

H_SIZE_2: H_SIZE during adjustment of Hsize2 [data]

V_SIZE_2: V_SIZE during adjustment of Vsize2 [data]

H_ACT_RATIO: horizontal active ratio of signals of adjustment windows G1 and G2

V_ACT_RATIO: vertical active ratio of signals of adjustment windows G1 and G2

Hraster: horizontal raster size corresponding to an arbitrary H_SIZE

Vraster: vertical raster size corresponding to an arbitrary V_SIZE

ASPECT_RATIO: Hraster/Vraster (the aspect ratio of raster)

Figure 4:
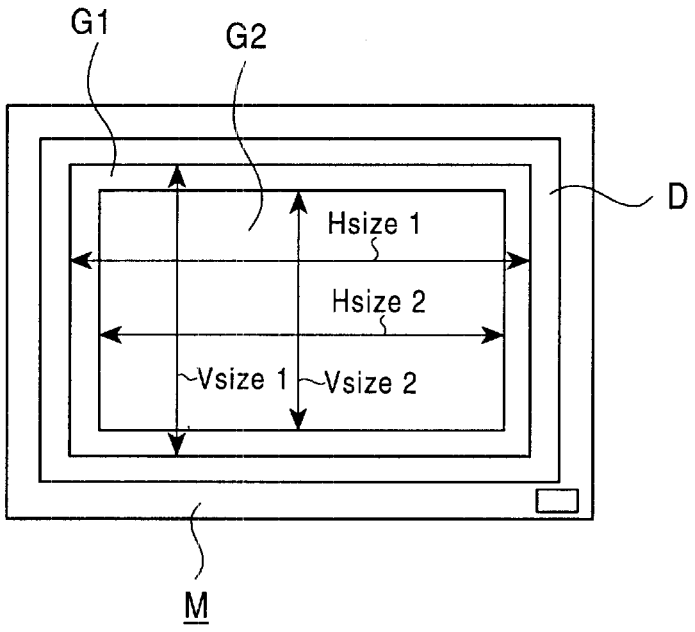
FIG. 4 is a view illustrating an adjustment method performed for realizing the zoom function in this embodiment.

In the adjustment described earlier in the manufacturing stage, for example, a video signal of the adjustment image G1 of the image size 1 is input and displayed first, as shown in FIG. 4. The adjustment image G1 has an image size of Hsize1 (horizontal size) and Vsize1 (vertical size). Further, the active ratio with respect to the raster of the adjustment image G1 takes a default value so that the preset, predetermined H_ACT_RATIO (horizontal active ratio) and V_ACT_RATIO (vertical active ratio) are obtained.

In the adjustment for the adjustment image G1, H_SIZE is varied to perform adjustment so that the actual length of the horizontal size of the adjustment image G1 displayed on the display screen D becomes the preset, predetermined Hsize1, and similarly, V_SIZE is varied to perform adjustment so that the actual length of the vertical size thereof becomes the preset, predetermined Vsize1.

H_SIZE when the predetermined Hsize1 is obtained at this time is defined as H_SIZE_1, and V_SIZE when the predetermined Vsize1 is obtained is defined as V_SIZE_1.

Next, the horizontal/vertical size of the adjustment image G1 is adjusted, so that the adjustment image G2 (having Hsize2 and Vsize2 as the image size 2) of the image size different from that of the adjustment image G1 is formed on the display screen D. In this case, the vertical/horizontal active ratio of the adjustment image G2 is set as H_ACT_RATIO and V_ACT_RATIO, which are the same as those of the adjustment image G1.

Also, when the adjustment image G2 is formed, adjustment is performed by varying H_SIZE so that the actual length of the horizontal size becomes the predetermined Hsize2. Similarly, adjustment is performed by varying V_SIZE so that the actual length of the vertical size becomes the predetermined Vsize2. H_SIZE when the predetermined Hsize2 is obtained at this time is defined as H_SIZE_2, and V_SIZE when the predetermined Vsize2 is obtained is defined as V_SIZE_2.

The parameter value determined by the adjustment by the above-described steps makes it possible to obtain information such as the following. In this case, referring to FIG. 5, consideration will first be given to the horizontal direction.

Figure 5:
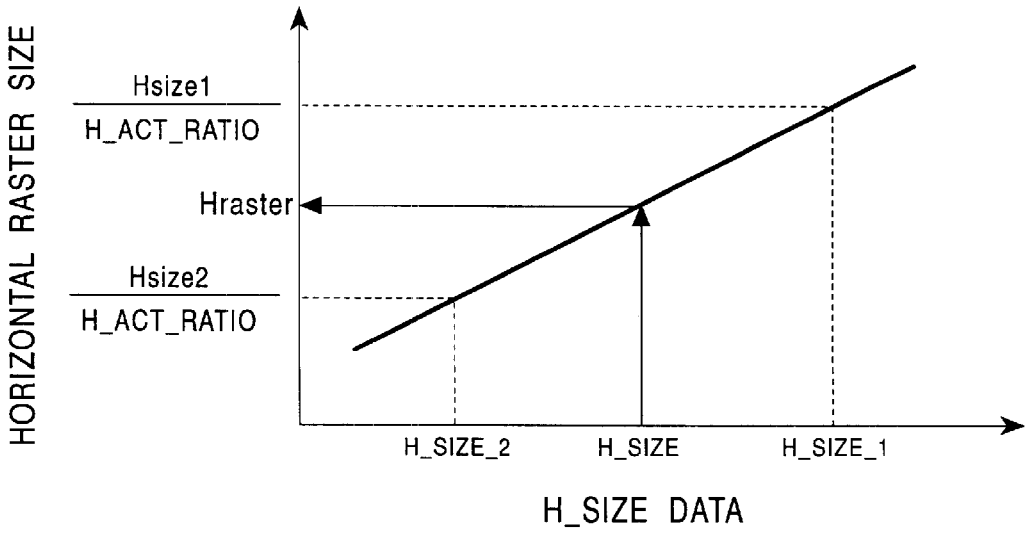
FIG. 5 is a view illustrating the relationship between the horizontal-size variable parameter obtained by the adjustment for the zoom function and the horizontal raster size.

FIG. 5 shows the relationship between the horizontal-size variable-parameter value (H_SIZE) (horizontal axis) and the horizontal raster size actually formed on the tube surface.

In this case, the horizontal raster size when the horizontal-size variable parameter is H_SIZE_1, that is, the horizontal size of the raster, corresponding to when the adjustment image G1 is correctly displayed in terms of size, can be determined by Hsize1/H_ACT_RATIO. Similarly, the horizontal raster size when the adjustment image G2 is correctly displayed and the horizontal-size variable parameter is H_SIZE_2 can be determined by Hsize2/H_ACT_RATIO.

In FIG. 5, by sampling two points on the basis of the parameter values obtained by the adjustments of the adjustment windows G1 and G2, the relationship of the horizontal raster size with respect to the variation of the horizontal-size variable-parameter value (H_SIZE) is obtained.

This shows that the relationship of the horizontal raster size with respect to the variation of the horizontal-size variable-parameter value (H_SIZE) can be obtained as a primary function. If an arbitrary horizontal-size variable-parameter value (H_SIZE) is provided with respect to the horizontal axis of the primary function shown in FIG. 5, it is possible to determine uniquely the horizontal raster size (Hraster) at an arbitrary horizontal-size variable-parameter value (H_SIZE).

In this case, the relationship of the horizontal raster size (Hraster) with respect to the variation of the horizontal-size variable-parameter value (H_SIZE [data]) shown in FIG. 5 is expressed by a primary function as shown below:

$$Hraster = K_H(\text{H_SIZE} - \text{H_SIZE_2}) + \frac{Hsize2}{\text{H_ACT_RATIO}} \tag{3-1}$$

$$K_H = \frac{Hsize1 - Hsize2}{\text{H_SIZE} - \text{H_SIZE_2}} \cdot \frac{1}{\text{H_ACT_RATIO}} \tag{3-2}$$

where the coefficient $K_H$, in equation (3-2) above, indicates the amount of variation of the horizontal raster size (Hraster)

with respect to the amount of variation corresponding to one step as the horizontal-size variable-parameter value (H_SIZE).

In accordance with the above-described description with reference to FIG. 5, the relationship between the vertical-size variable-parameter value (V_SIZE) and the vertical raster size (Vraster) can also be expressed by a primary function shown below on the basis of the parameter for the vertical direction obtained by the adjustment described in FIG. 4:

$$Vraster = K_V(\text{V_SIZE} - \text{V_SIZE_2}) + \frac{Vsize2}{\text{V_ACT_RATIO}} \quad (4\text{-}1)$$

$$K_V = \frac{Vsize1 - Vsize2}{\text{V_SIZE_1} - \text{V_SIZE_2}} \cdot \frac{1}{\text{V_ACT_RATIO}} \quad (4\text{-}2)$$

That is, the vertical raster size (Vraster) at an arbitrary vertical-size variable-parameter value (V_SIZE) can be determined uniquely.

Therefore, in this embodiment, after the adjustment described in FIG. 4 is performed, each of the parameters Hsize1, Vsize1, Hsize2, Vsize2, H_ACT_RATIO, and V_ACT_RATIO prepared for this adjustment, and the information of each of the parameters H_SIZE_1, V_SIZE_1, H_SIZE_2, and V_SIZE_2 obtained as a result of the adjustment using the above-described parameters are stored in the ROM 3.

Consequently, in the monitor apparatus of this embodiment, as a result of the performance of the computation process by the control section 2 using the above-described parameters stored in the ROM 3, it is possible to compute the relationship of the horizontal raster size (Hraster) with respect to the horizontal-size variable-parameter value (H_SIZE) and the relationship of the vertical raster size (Vraster) with respect to the vertical-size variable-parameter value (V_SIZE). In this embodiment, by performing a required process by using these parameters, the zoom function for maintaining the aspect ratio of the display image at a constant is realized in the manner described below.

(3-c. The processing operation during zoom mode)

Next, the processing operation during the zoom mode for realizing the zoom function in this embodiment will be described with reference to FIGS. 6 and 7.

In the monitor apparatus of this embodiment, in order to realize the zoom function for enlarging or reducing an image while maintaining the aspect ratio thereof at a constant, initially, the ratio (ASPECT_RATIO) of the horizontal/vertical size of a raster RS when an image is displayed in an initial state is computed and stored. Hereinafter, when the image size is varied during the zoom mode in accordance with the operation steps described in FIG. 2, the vertical size and the horizontal size of the raster RS are varied while maintaining this ASPECT_RATIO at the time of the initial state.

Accordingly, with reference to the flowchart of FIG. 6, the processing operation for computing the ASPECT_RATIO at an initial state will be described first.

Here, "an initial state" refers to the power-on time when the power of the monitor apparatus is switched on, a case in which the resolution (a video input signal from the computer apparatus) is switched, or a case in which the horizontal or the vertical size of the display image (raster) is changed independently by the user.

For example, when the power is switched on, the aspect ratio of the raster is not yet known, and when the resolution is changed and when the horizontal or the vertical size is changed independently, there is an increased possibility that the aspect ratio of the raster is different from that in the step before being changed. Therefore, in this embodiment, each time an initial state such as one of those described above is reached, the ASPECT_RATIO of the raster is computed.

Figure 6:
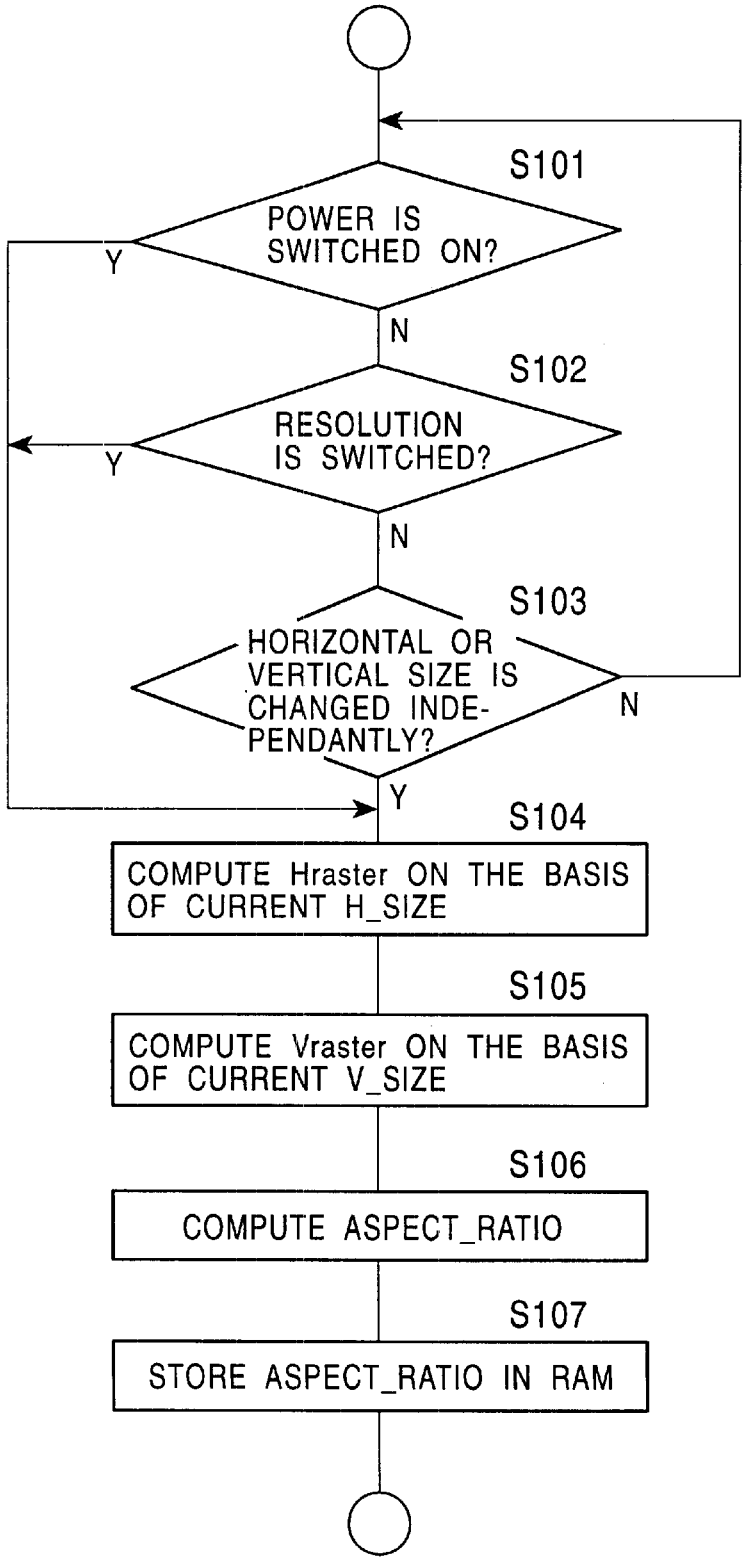
FIG. 6 is a flowchart showing the processing operation for computing the ratio (ASPECT_RATIO) of the horizontal/vertical size of a raster.

Also, the process shown in FIG. 6 is performed by the control section 2 within the monitor apparatus M.

Each of the above-described parameters Hsize1, Vsize1, Hsize2, Vsize2, H_ACT_RATIO, V_ACT_RATIO, H_SIZE_1, V_SIZE_1, H_SIZE 2, and V_SIZE_2 during adjustment is prestored in the ROM 3.

In the routine shown in FIG. 6, initially, in steps S101, S102, and S103, a check is made to determine which of the above-described initial states the monitor apparatus M is in. That is, in step S101, assuming that the monitor apparatus M is in an initial state, a check is made to determine whether or not the power has been switched on. In step S102, a check is made to determine whether or not the resolution has been switched. In step S103, a check is made to determine whether or not the horizontal or the vertical size has been changed independently. When the result is "YES" in any one of steps S101, S102, and S103, the process proceeds to step S104.

In step S104, Hraster (horizontal raster size) is computed on the basis of the current H_SIZE (horizontal-size variable parameter).

In the case when the process proceeds from step S101 to step S104, the current horizontal-size variable parameter is the H_SIZE corresponding to the horizontal raster size displayed when the power is switched on. When the process proceeds from step S102 to step S104, the current horizontal-size variable parameter is the H_SIZE when the raster is displayed on the basis of the switched resolution. When the process proceeds from step S103 to step S104, the current horizontal-size variable parameter is the H_SIZE immediately after the horizontal raster size is varied independently. If in step S103 only the vertical raster size has been varied independently, the processing of this step S104 is bypassed, and the process moves to the process of step S105, which is described later.

In this step S104, by substituting the current H_SIZE into the equation shown earlier as equation (3), Hraster (horizontal raster size) of the raster actually formed on the tube surface in such a manner as to correspond to the current H_SIZE is computed.

As described above, the parameters other than the H_SIZE in equation (3) are prestored in the ROM 3 in the adjustment stage before shipment from the factory.

In step S105, a computation of Vraster (vertical raster size) is performed on the basis of the current V_SIZE (vertical-size variable parameter).

In the same manner as in step S104, in this case when the process proceeds from step S101 to step S105, the current vertical-size variable parameter V_SIZE is the V_SIZE corresponding to the vertical raster size displayed when the power is switched on. When the process proceeds from step S102 to step S105, the current vertical-size variable parameter V_SIZE is the V_SIZE when the raster is displayed on the basis of the switched resolution. When the process proceeds from step S103 to step S105, the current vertical-size variable parameter V_SIZE is the H_SIZE immediately after the vertical raster size is varied independently.

In this step S105, by substituting the current V_SIZE into the equation shown earlier as equation (4), Vraster (vertical raster size) of the raster actually formed on the tube surface in such a manner as to correspond to the current V_SIZE is computed. Also in this case, in the same manner as in step S104, the parameters other than V_SIZE in equation (4) are prestored in the ROM 3 in the adjustment stage before shipment from the factory, as stated above.

Having been through steps S104 and S105 described above, the information of the Hraster (horizontal raster size) and Vraster (vertical raster size) of the raster which is being displayed currently is obtained. In the subsequent step S106, by using Hraster and Vraster obtained in steps S104 and S105 described above, the ratio of the horizontal/vertical size (ASPECT_RATIO) of the raster which is being displayed currently is computed. The ASPECT_RATIO is computed by the following equation on the basis of the above-described Hraster and Vraster:

$$\text{ASPECT_RATIO} = \frac{Hraster}{Vraster} \tag{5}$$

In the next step S107, a process for storing the ASPECT_RATIO computed in step S106, for example, in the RAM 2*a* within the control section 2 is performed, and the process exits this routine. This terminates the ASPECT_RATIO setting process in the initial state.

Next, referring to the flowchart of FIG. 7, the processing operation during the zoom mode in this embodiment will be described. At the stage in which the process shown in FIG. 7 is performed, having been through the process shown in FIG. 6, the data for the ASPECT_RATIO of the raster in the initial state is stored in the RAM 2*a*.

For example, when the zoom mode is set in accordance with the operation steps described earlier in FIG. 2, and an operation for changing the image size is performed, in this routine, the process proceeds from step S201 to step S202 where a process for updating the H_SIZE (horizontal-size variable parameter) to a new H_SIZE in proportion with the amount of variation of the parameter by the operation is performed.

That is, in the case where the image size is changed using the zoom mode, the H_SIZE is used as a reference. In the processing of the control section 2 in step S202, H_SIZE is updated according to the parameter value set by the parameter value icon I3 of the zoom adjustment window $W_Z$ of FIG. 2C. Then, based on the updated H_SIZE, the V_SIZE is also changed and set so that the previously obtained ASPECT_RATIO becomes constant, as will be described below.

After the H_SIZE is updated in step S202 in the above-described manner, the process proceeds to step S203. In step S203, the V_SIZE (vertical-size variable parameter) is computed as described below using the H_SIZE updated in step S202:

$$\text{V_SIZE} = \left(Vraster - \frac{Vsize2}{\text{V_ACT_RATIO}}\right) \cdot \frac{1}{K_V} + \text{V_SIZE_2} \tag{6-1}$$

$$Vraster = \frac{Hraster}{\text{ASPECT_RATIO}} \tag{6-2}$$

$$Hraster = K_H(\text{H_SIZE} - \text{H_SIZE_2}) + \frac{Hsize2}{\text{H_ACT_RATIO}} \tag{6-3}$$

According to equations (6-1 to 6-3), the horizontal raster size (Hraster) actually formed on the tube surface in such a manner as to correspond to H_SIZE obtained in step S201 is computed using equation (6-3). Then, using the Hraster and ASPECT_RATIO which were computed earlier by the process of FIG. 6, the vertical raster size (Vraster) is computed on the basis of equation (6-2). Vraster computed here will have a size (value) such that the ASPECT_RATIO becomes constant with respect to the Hraster computed on the basis of equation (6-3).

Use of the value of the Vraster makes it possible to compute V_SIZE (vertical-size variable parameter) for forming the above-described Vraster on the basis of equation (6-1).

In equation (6-1), the adjustment image G2 (image size 2) described in FIG. 4 is used as a reference.

Then, when a new V_SIZE has been computed in step S203, in the subsequent step S204, a process for updating the current V_SIZE to the V_SIZE computed in step S203 is performed.

Next, in step S205, by controlling the horizontal deflection circuit 6 and the vertical deflection circuit 7 on the basis of the H_SIZE and the V_SIZE which were updated in steps S202 and S204 described above, the sizes (Hraster and Vraster) of the raster displayed on the tube surface are changed simultaneously.

The raster formed by the process of step S205 has the same aspect ratio as the aspect ratio of the raster displayed in the stage before the image size is changed by an operation by the user in the zoom mode. As a result, the size of the display image formed on the raster is also changed in such a manner as to maintain the same aspect ratio as that before the image size is changed.

In this way, in this embodiment, it is possible to vary the size of the display image while maintaining the aspect ratio thereof at a constant.

Figure 7:
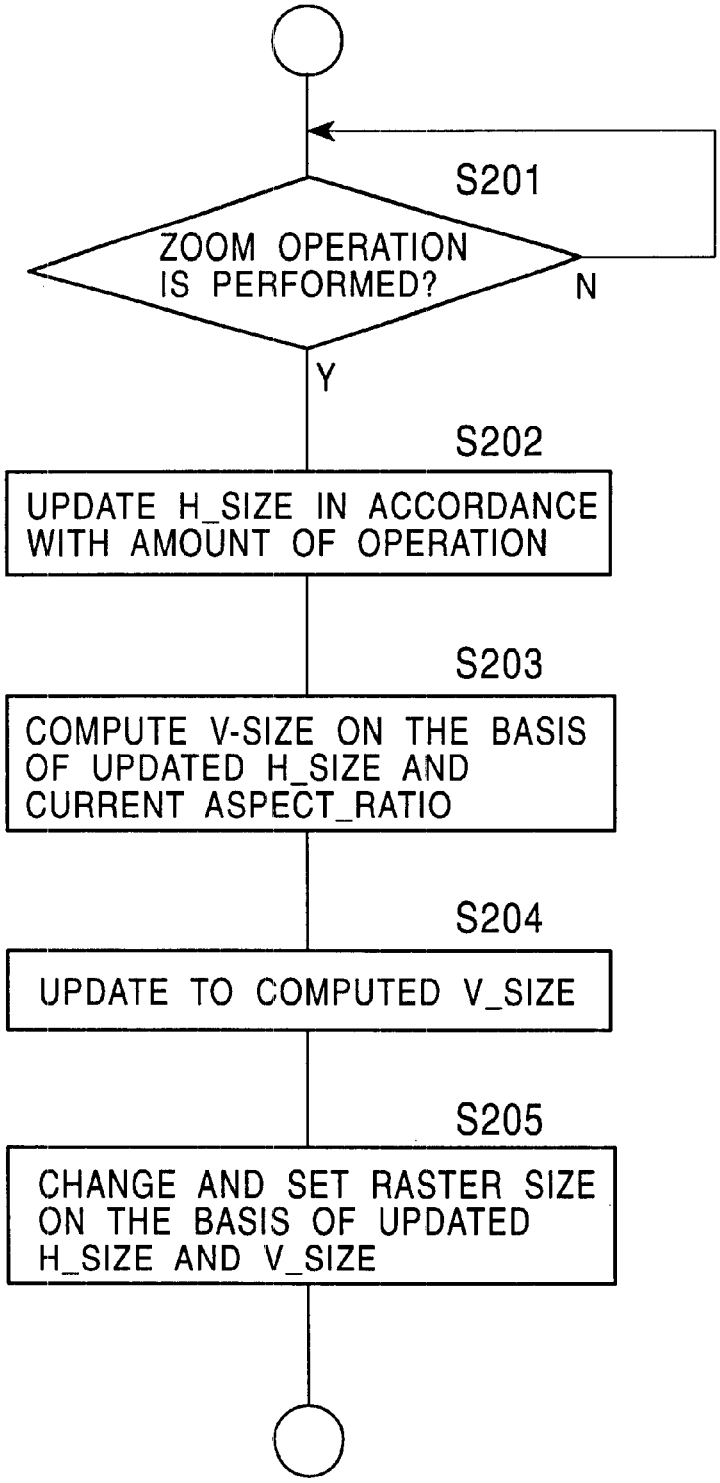
FIG. 7 is a flowchart showing the processing operation during the zoom mode in this embodiment.
Figure 8A:
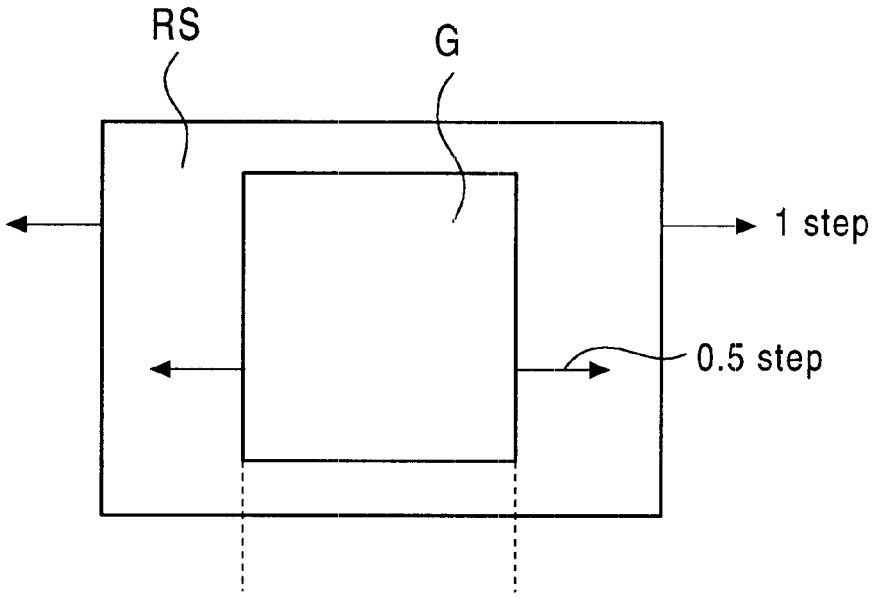
FIGS. 8A and 8B are views illustrating a difference in the size variable ratio of a display image with respect to the raster in accordance with the active ratio.
Figure 8B:
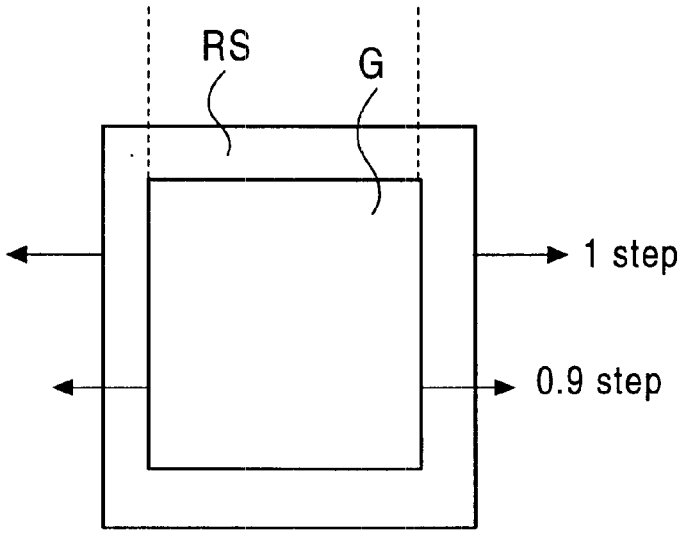
Figure 9A:
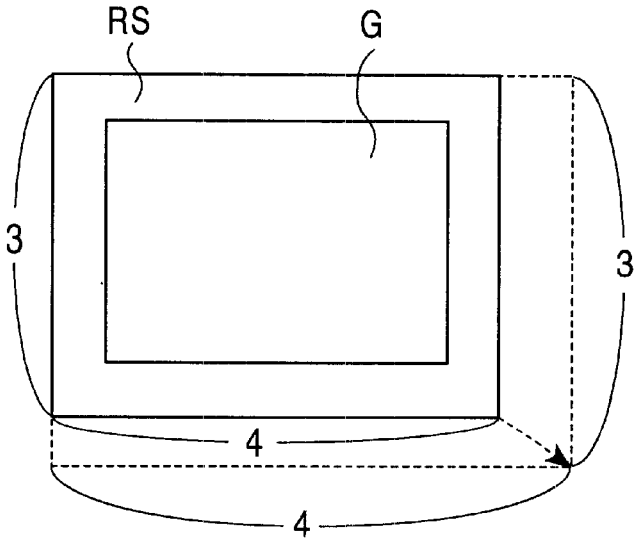
FIGS. 9A and 9B are views illustrating examples of the changed state of the display image when the raster size is varied in accordance with a fixed ratio.
Figure 9B:
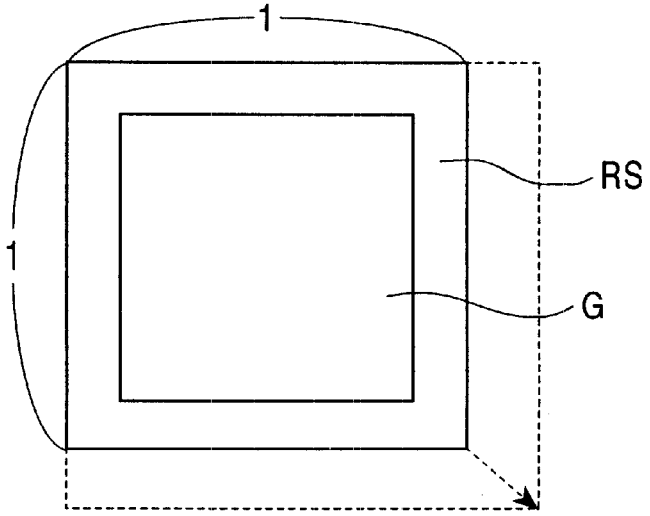

Although the V_SIZE is computed such that the ASPECT_RATIO becomes constant in such a manner as to correspond to the updated H_SIZE by using the H_SIZE as a reference in FIG. 7 described above, alternatively, H_SIZE such that the ASPECT_RATIO becomes constant in such a manner as to correspond to the updated V_SIZE may be computed by using V_SIZE as a reference.

In this case, in step S202 of FIG. 7, a process for updating V_SIZE, instead of H_SIZE, according to the amount of operation of the parameter is performed. Then, the construction may be formed such that in step S203, H_SIZE which causes ASPECT_RATIO to be constant in such a manner as to correspond to the V_SIZE updated in step S202 is computed as described below:

$$\text{H_SIZE} = \left(Hraster - \frac{Hsize2}{\text{H_ACT_RATIO}}\right) \cdot \frac{1}{K_H} + \text{H_SIZE_2} \tag{7-1}$$

$$Hraster = \text{ASPECT_RATIO} \cdot Vraster \tag{7-2}$$

$$Vraster = K_V(\text{V_SIZE} - \text{V_SIZE_2}) + \frac{Vsize2}{\text{V_ACT_RATIO}} \tag{7-3}$$

and then, in step S204, a process for updating H_SIZE to this computed H_SIZE is performed.

The present invention is not limited to the above-described construction, and various modifications are possible. For example, in addition to the adjustment method described up to this point and a method using parameters and computation equations, it is possible to determine H_SIZE and V_SIZE for varying the raster size while maintaining the aspect ratio thereof at a constant by another adjustment method and another method using parameters and computation equations as long as the raster size is varied with the result that the aspect ratio thereof is maintained at a constant.

Further, the present invention is particularly effective in applications to a computer system in which the aspect ratio of an image is not specified because it has a plurality of types of resolution and has the function of varying the image size in the horizontal/vertical direction independently. However, the present invention is not limited to this case, and may be applied to, for example, a monitor apparatus compatible with conventional television systems, other specific systems, and others.

As has been described up to this point, the advantage of the present invention is that the size of an image displayed on the monitor apparatus can be changed while maintaining the aspect ratio thereof at a constant, regardless of the factors, such as an influence from the configuration of the horizontal/vertical deflection circuit system as hardware, an influence from differences in the active ratio of the image with respect to the raster, or an influence from the aspect ratio, which is different each time the horizontal size or the vertical direction of the image is changed independently by the user.

As a result, since the horizontal/vertical balance of the display image is not distorted because the image size has been changed, it is very useful in a case where, for example, a user wants to perform enlargement/reduction while maintaining the horizontal/vertical balance of the image drawn on the monitor apparatus during usage by the user.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A raster scan display apparatus for maintaining an aspect ratio of a displayed image window when the size of a display area of said apparatus is changed, comprising:

first changing means for changing a first length of said display area along the horizontal direction and a second length of said display area along the vertical direction;

computation means for computing a new horizontal length for said displayed image window on the basis of the change in said first length of said display area and a new vertical length for said displayed image window on the basis of the aspect ratio of said display area before the size was changed; and second changing means for changing the size of said displayed image window on the basis of the new horizontal and vertical lengths computed by said computation means.

2. A raster scan display apparatus according to claim 1, wherein said first changing means changes said first and second lengths according to an operation by a user.

3. A raster scan display apparatus according to claim 2, further comprising: storage means for storing the aspect ratio of said display area in advance.

4. A raster scan display apparatus according to claim 3, further comprising: detection means for detecting the aspect ratio of said display area when the power is switched on, the detected aspect ratio being stored in said storage means.

5. A raster scan display apparatus according to claim 3, further comprising: detection means for detecting the aspect ratio of said display area when a resolution is changed, the detected aspect ratio being stored in said storage means.

6. A raster scan display apparatus according to claim 3, further comprising: detection means for detecting the aspect ratio of said display area when one length of said display area along the horizontal or vertical direction is changed, the detected aspect ratio being stored in said storage means.

7. A raster scan display apparatus according to claim 3, wherein said storage means further has stored therein in advance information for the ratio of the variation in the raster size on a screen with respect to the variation in an internal parameter.

8. A raster scan display apparatus according to claim 7, wherein said information is stored in said storage means at a manufacturing stage.

9. A size changing method for maintaining an aspect ratio of a displayed image window when the size of a display area of a raster scan display apparatus is changed, said method comprising the steps of:

a first step of changing a first length of said display area along the horizontal direction and a second length of said display area along the vertical direction;

a second step of computing a new horizontal length for said displayed image window on the basis of the change in said first length of said display area and a new vertical length for said displayed image window on the basis of the aspect ratio of said display area before the size was changed; and a third step of changing the size of said displayed image window on the basis of the computed new horizontal and vertical lengths.

10. A size changing method according to claim 9, wherein said first step changes said first and second lengths according to an operation by a user.

11. A size changing method according to claim 10, wherein the aspect ratio of said display area is stored in a memory in advance, and in said second step, said new vertical length is computed on the basis of the aspect ratio read from the memory.

12. A size changing method according to claim 11, further comprising: a fourth step for detecting the aspect ratio of said display area when the power is switched on, the detected aspect ratio being stored in said memory.

13. A size changing method according to claim 11, further comprising: a fifth step for detecting the aspect ratio of said display area when a resolution is changed, the detected aspect ratio being stored in said memory.

14. A size changing method according to claim 11, further comprising: a sixth step for detecting the aspect ratio of said display area when one length of said display area along the horizontal or vertical direction is changed, the detected aspect ratio being stored in said memory.

15. A size changing method according to claim 11, wherein said memory further has stored therein in advance information for the ratio of the variation in the raster size on a screen with respect to the variation in an internal parameter.

16. A size changing method according to claim 15, wherein said information is stored in said storage means at a manufacturing stage.

* * * * *